US009863448B2

(12) United States Patent
Ueda

(10) Patent No.: US 9,863,448 B2
(45) Date of Patent: Jan. 9, 2018

(54) HYDRAULIC CIRCUIT FOR CONSTRUCTION MACHINE

(71) Applicant: KOBELCO CONSTRUCTION MACHINERY CO., LTD., Hiroshima-shi (JP)

(72) Inventor: Koji Ueda, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 357 days.

(21) Appl. No.: 14/443,444

(22) PCT Filed: Nov. 19, 2013

(86) PCT No.: PCT/JP2013/006796
§ 371 (c)(1),
(2) Date: May 18, 2015

(87) PCT Pub. No.: WO2014/091683
PCT Pub. Date: Jun. 19, 2014

(65) Prior Publication Data

US 2015/0330413 A1 Nov. 19, 2015

(30) Foreign Application Priority Data

Dec. 13, 2012 (JP) ..... 2012-272216

(51) Int. Cl.
*F15B 11/08* (2006.01)
*E02F 9/22* (2006.01)

(52) U.S. Cl.
CPC ..... *F15B 11/08* (2013.01); *E02F 9/2217* (2013.01); *E02F 9/2225* (2013.01); (Continued)

(58) Field of Classification Search
CPC ..... E02F 9/2217; E02F 9/2225; E02F 9/2239; E02F 9/2282; E02F 9/2292; F15B 11/08; (Continued)

(56) References Cited

U.S. PATENT DOCUMENTS

2005/0229594 A1 10/2005 Nanjo et al.

FOREIGN PATENT DOCUMENTS

CN 1676785 A 10/2005
JP 04 325222 11/1992
(Continued)

OTHER PUBLICATIONS

Combined Chinese Office Action and Search Report dated Dec. 28, 2015 in Patent Application No. 201380061558.4 (with English summary and English translation of categories of cited documents).
(Continued)

*Primary Examiner* — Logan Kraft
(74) *Attorney, Agent, or Firm* — Oblon, McClelland, Maier & Neustadt, L.L.P.

(57) ABSTRACT

A hydraulic circuit for a construction machine, capable of enhancing the effect of reducing a pressure loss due to return oil from a head-side chamber of a hydraulic cylinder, with a simple structure. The circuit includes a hydraulic cylinder, a control valve, a return pipeline, and a tank direct-communication line providing direct communication between the control valve and a tank separately from the return pipeline. The control valve has a flow path leading return oil from a head-side chamber of the hydraulic cylinder to the tank direct-communication line and a flow path leading return oil from a rod-side chamber of the hydraulic cylinder to the return pipeline.

2 Claims, 2 Drawing Sheets

(52) U.S. Cl.
CPC ..... *E02F 9/2239* (2013.01); *E02F 9/2282* (2013.01); *E02F 9/2292* (2013.01); *F15B 2211/205* (2013.01); *F15B 2211/20576* (2013.01); *F15B 2211/212* (2013.01); *F15B 2211/255* (2013.01); *F15B 2211/30525* (2013.01); *F15B 2211/31558* (2013.01); *F15B 2211/4159* (2013.01); *F15B 2211/45* (2013.01); *F15B 2211/46* (2013.01); *F15B 2211/5156* (2013.01); *F15B 2211/555* (2013.01); *F15B 2211/611* (2013.01); *F15B 2211/62* (2013.01); *F15B 2211/7053* (2013.01); *F15B 2211/8609* (2013.01); *F15B 2211/88* (2013.01)

(58) Field of Classification Search
CPC ..... F15B 2211/205; F15B 2211/20576; F15B 2211/212; F15B 2211/255; F15B 2211/30525; F15B 2211/31558; F15B 2211/4159; F15B 2211/45; F15B 2211/46; F15B 2211/5156; F15B 2211/555; F15B 2211/611; F15B 2211/62; F15B 2211/7053; F15B 2211/8609; F15B 2211/88
See application file for complete search history.

(56) References Cited

FOREIGN PATENT DOCUMENTS

| | | | |
|---|---|---|---|
| JP | 09 151488 | | 6/1997 |
| JP | 2001-116006 | A | 4/2001 |
| JP | 2002-97673 | A | 4/2002 |
| JP | 2002 339904 | | 11/2002 |
| JP | 2003-97507 | A | 4/2003 |
| JP | 2005 155698 | | 6/2005 |
| JP | 2006 071105 | | 3/2006 |
| JP | 2010-174574 | | 8/2010 |
| JP | 2010-185515 | A | 8/2010 |
| JP | 4642269 | B2 | 12/2010 |

OTHER PUBLICATIONS

International Search Report dated Dec. 24, 2013 in PCT/JP13/006796 Filed Nov. 19, 2013.
Combined Chinese Office Action and Search Report dated Aug. 29, 2016 in Patent Application No. 201380061558.4 (with unedited computer generated English translation and English translation of categories of cited documents).

HYDRAULIC CIRCUIT FOR CONSTRUCTION MACHINE

TECHNICAL FIELD

The present invention relates to a hydraulic circuit for a construction machine such as a hydraulic shovel.

BACKGROUND ART

There will be described background art of the present invention with reference to an example of a shovel shown in FIG. 2.

The shovel includes a crawler-type lower traveling body; an upper slewing body 2 disposed on the lower traveling body so as to be able to be slewed around an axis X perpendicular to a ground; a front attachment 3 attached to the upper slewing body 2 to be operated so as to perform excavating operation and so forth; a plurality of hydraulic actuators; and a hydraulic pump that supplies hydraulic oil to the hydraulic actuators. The front attachment 3 includes a boom 4 capable of being raised and lowered; an arm 5 connected to a distal end of the boom 4 rotatably around a laterally horizontal axis; and a bucket 6 connected to a distal end of the arm 5 rotatably around a laterally horizontal axis in the horizontal direction. The plurality of hydraulic actuators include a boom cylinder 7 that raises and lowers the boom 4; an arm cylinder 8 that causes the arm 5 to make rotational movement in a push direction and a retraction direction; a bucket cylinder 9 that causes the bucket 6 to perform excavating and dumping operations; left and right travelling motors that drive the lower traveling body 1 to make it travel; and a slewing motor that slews the upper slewing body 2. Control valves are interposed between the respective hydraulic actuators and the hydraulic pump that is a hydraulic source for the hydraulic actuators. The control valves are operated to control supply and discharge of the hydraulic oil from the hydraulic pump to the respective hydraulic actuators, thereby controlling respective operations of the hydraulic actuators (extension and retraction of each of the hydraulic cylinders, and forward and reverse rotation of the motors).

The hydraulic-cylinder circuit for operating the hydraulic cylinder, included in the hydraulic circuits for operating each of the hydraulic actuators, involves a problem that pressure loss on the return side are increased when the hydraulic cylinder is retracted. This will be described with reference to an example shown in FIG. 3, a circuit for operating the arm cylinder 8.

The circuit includes a hydraulic pump 10, a tank T, a hydraulic-pilot-controlled control valve 11, a not-graphically-shown remote control valve, a head-side pipeline 12, a rod-side pipeline 13, and a return pipeline 14. The control valve 11 is interposed between the arm cylinder 8 and a pair of the hydraulic pump 10 and the tank T, being operated by the remote control valve. The arm cylinder 8 includes a cylinder body, a piston accommodated in a cylinder body; and a rod extending axially from the piston, the piston partitioning the interior of the cylinder body into a head-side chamber (also referred to as a bottom-side chamber) 8*a* and a rod-side chamber 8*b*. The head-side pipeline 12 connects the head-side chamber 8*a* to the control valve 11, whereas the rod-side pipeline 13 connects the rod-side chamber 8*b* to the control valve 11. The return pipeline 14 connects the control valve 11 to the tank T. The return pipeline 14 is provided with a spring-type check valve and an oil cooler 16, the check valve being a back-pressure valve 15 adapted to generate constant back-pressure. The control valve 11 has a neutral position 11*a*, an arm-push position (cylinder-retraction position) 11*b*, and an arm-retraction position (cylinder-extension position) 11*c*, being switchable over the positions to enable supply and discharge the hydraulic oil to and from the arm cylinder 8 to be controlled, in other words, to enable the extension and retraction operations of the arm cylinder 8 to be controlled.

The return-side pressure loss occurs because the volume of the head-side chamber 8*a* is greater than that of the rod-side chamber 8*b*. Specifically, upon the operation of the arm cylinder 8 in the retraction direction, the difference between the volumes of the chambers 8*a* and 8*b* causes a large amount of oil to be flowed from the head-side chamber 8*a* to the return pipeline 14, thereby increasing the pressure loss due to the back-pressure valve 15 and the oil cooler 16 in the return pipeline 14 and thus increasing power loss. In particular, when driven in the push direction, the arm 5 is accelerated by its own weight to thereby especially increasing the pressure loss.

As countermeasures against the above problem, Patent Literature 1 discloses a hydraulic circuit having two return pipelines for leading return oil to a tank when a hydraulic cylinder is retracted. This hydraulic circuit includes a quick return circuit with a relief valve, the quick return circuit connected to one of the return pipelines to allow a part of return oil on the head side, when the hydraulic cylinder is fully retracted, to be flowed to the tank through a path including the quick return circuit. This allows the pressure loss on the return side to be reduced.

This technique, however, requires two high pressure pipes, a relief valve and the like on the return side when the hydraulic cylinder is retracted, thus involving complication of the circuit structure and requiring many parts, which increases cost. In addition, quickly returning the return oil by opening the relief valve raises relief pressure, which weakens the effect of reducing the pressure loss.

CITATION LIST

Patent Literature

Patent Literature 1: Japanese Unexamined Patent Publication No. 2002-339904

SUMMARY OF INVENTION

An object of the present invention is to provide a hydraulic circuit for a construction machine including a hydraulic cylinder, the hydraulic circuit being capable of achieving a significant effect of reducing a pressure loss due to return oil flowed from a head-side chamber of the hydraulic cylinder, with a simple structure. The provided hydraulic circuit includes: a hydraulic pump that discharges hydraulic oil; a hydraulic cylinder having a head-side chamber and a rod-side chamber and configured to be extended and retracted by hydraulic oil supplied from the hydraulic pump to the head-side chamber and the rod-side chamber; a control valve disposed between the hydraulic pump and the hydraulic cylinder and operated to control supply and discharge of the hydraulic oil to and from the hydraulic cylinder; a head-side pipeline connecting the head-side chamber of the hydraulic cylinder to the control valve; a rod-side pipeline connecting the rod-side chamber of the hydraulic cylinder to the control valve; a return pipeline connecting the control valve to a tank; a back-pressure valve provided to the return pipeline; an oil cooler provided to the return pipeline; and a tank direct-communication line other than the return pipeline, the tank direct-communication line providing direct communication between the control valve and the tank. The control valve has a first return flow path that leads return oil flowed from the head-side chamber of the hydraulic cylinder to the tank direct-communication line and a second return flow path that leads return oil flowed from the rod-side chamber of the hydraulic cylinder to the return pipeline.

DESCRIPTION OF EMBODIMENTS

Figure 1:
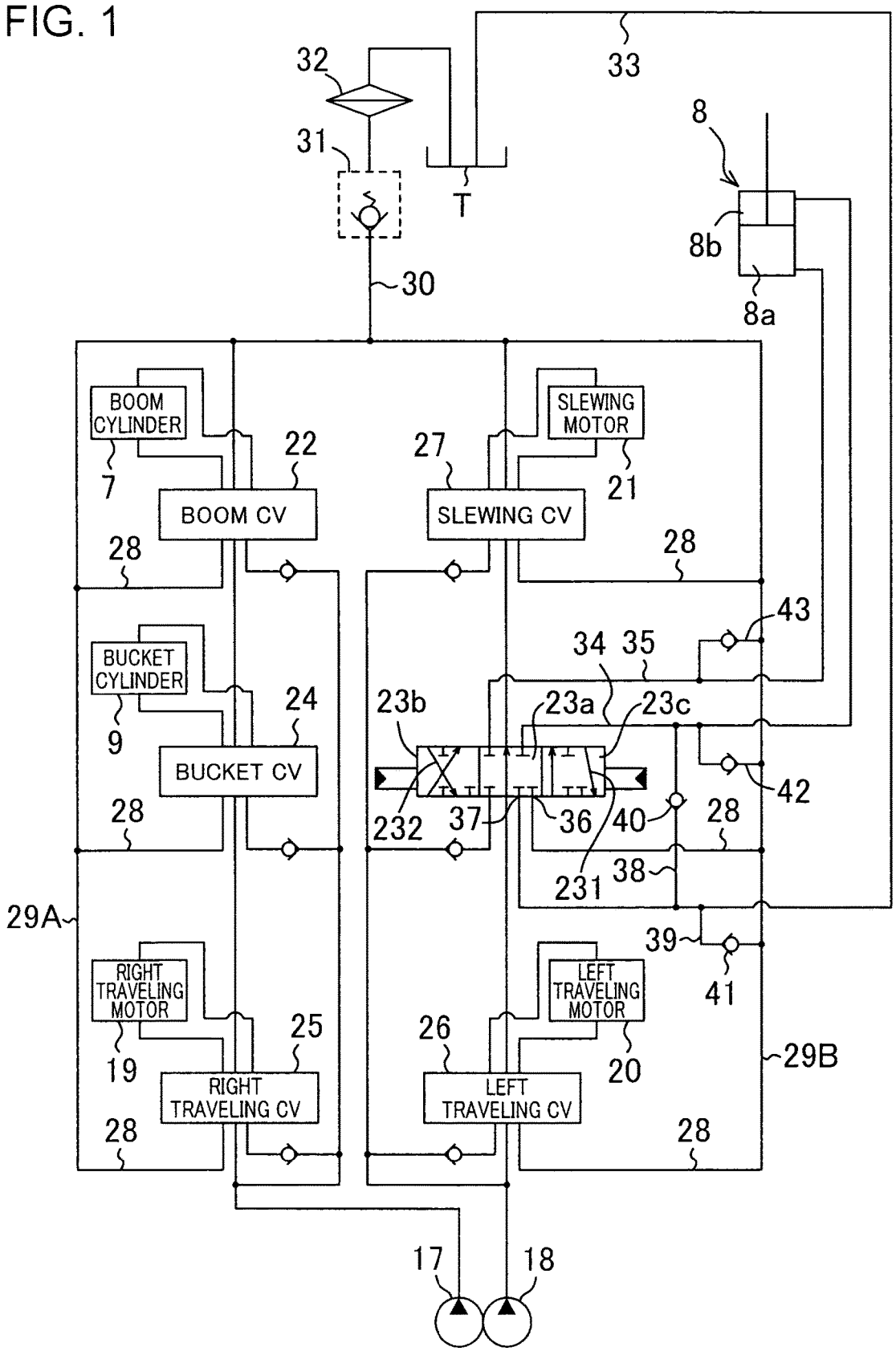
FIG. 1 is a circuit diagram showing a hydraulic circuit according to an embodiment of the present invention.
Figure 2:
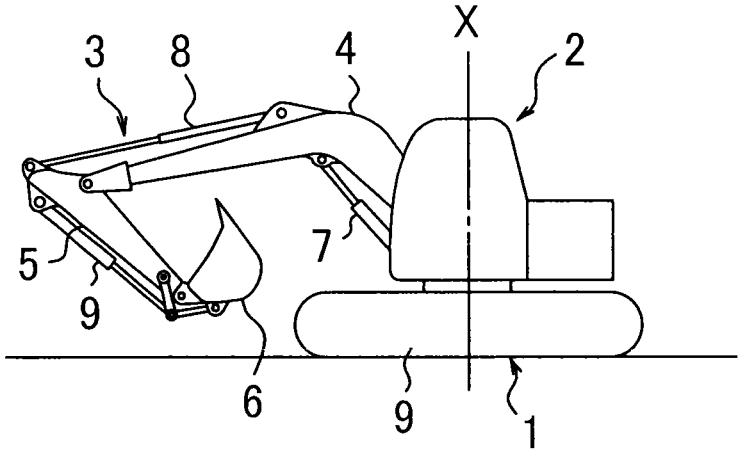
FIG. 2 is an outlined side view showing a hydraulic shovel that is a construction machine equipped with the hydraulic circuit.
Figure 3:
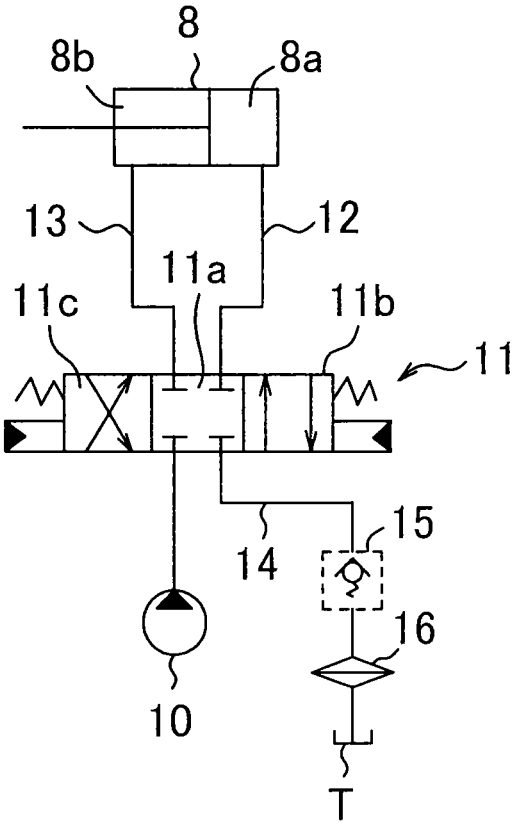
FIG. 3 is a circuit diagram showing a hydraulic circuit of a conventional construction machine.

There will be described an embodiment of the present invention with reference to FIG. 1, which shows a hydraulic circuit according to the present embodiment. The hydraulic circuit is on board of a hydraulic shovel shown in FIG. 2.

The hydraulic circuit includes first and second hydraulic pumps 17 and 18 configured to be driven by an engine to thereby discharge hydraulic oil; a plurality of hydraulic actuators; a plurality of control valves; a head-side pipeline 35; a rod-side pipeline 34; a return pipeline; a back-pressure valve 31; an oil cooler 32; a tank direct-communication line 33; and a tank T.

The plurality of hydraulic actuators include a boom cylinder 7, an arm cylinder 8, a bucket cylinder 9, a right traveling motor 19, a left traveling motor 20, and a slewing motor 21. The hydraulic oil discharged from the first hydraulic pump 17 can be supplied to the boom cylinder 7, the bucket cylinder 9, and the right traveling motor 19. The hydraulic oil discharged from the second hydraulic pump 18 can be supplied to the arm cylinder 8, the left traveling motor 20, and the slewing motor 21.

The plurality of control valves include a boom control valve 22 interposed between the first hydraulic pump 17 and the boom cylinder 7; an arm control valve 23 interposed between the second hydraulic pump 18 and the arm cylinder 8; a bucket control valve 24 interposed between the first hydraulic pump 17 and the bucket cylinder 9; a right traveling control valve 25 interposed between the first hydraulic pump 17 and the right traveling motor 19; a left traveling control valve 26 interposed between the second hydraulic pump 18 and the left traveling motor 20; and a slewing control valve 27 interposed between the second hydraulic pump 18 and the slewing motor 21. Each of the control valves 22 to 27 is a hydraulic-pilot-controlled one, which is operated by use of not-graphically-shown respective remote control valves to thereby control supply and discharge of the hydraulic oil to and from the corresponding hydraulic actuator, in other words, to thereby control an operation of the corresponding hydraulic actuator.

Among the plurality of hydraulic actuators, the arm cylinder 8 corresponds to the hydraulic cylinder according to the present invention. The arm cylinder 8 has a head-side chamber 8*a* and a rod-side chamber 8*b*. The head-side pipeline 35 connects the head-side chamber 8*a* to the arm control valve 23, whereas the rod-side pipeline 34 connects the rod-side chamber 8*b* to the arm control valve 23.

The return pipeline includes a plurality of individual return pipelines 28 provided for the control valves 22 to 27, respectively; a main tank line 30 connected to the tank T; and first and second tank lines 29A and 29B that merge return oil flowed in the individual return pipelines 28 into the main tank line 30. The return oil flowed from the hydraulic actuators 7 to 9 and the hydraulic actuators 19 to 21 is returned to the tank T through a path including the return pipeline, in normal times. The first tank line 29A is provided for the hydraulic actuators driven by the first hydraulic pump 17. The second tank line 29B is provided for the hydraulic actuators driven by the second hydraulic pump 18. Both the first and second tank lines 29A and 29B are connected to the tank T through the main tank line 30.

The back-pressure valve 31 and the oil cooler 32 are provided in series in the main tank line 30. The back-pressure valve 31 is a valve for generating constant back-pressure, and the oil cooler 32 is used for cooling the hydraulic oil.

The tank direct-communication line 33 is provided for the arm cylinder 8, providing direct communication between the arm control valve 23 and the tank T, separately from the conventional return pipeline. The arm control valve 23 is configured to allow the return oil flowed from the rod-side chamber 8*b* through the rod-side pipeline 34 to be returned to the tank T through a path equal to conventional one including the individual return pipelines 28, the second tank line 29B, and the main tank line 30 in this order, and to allow the return oil flowed from the head-side chamber 8*a* through the head-side pipeline 35 to be directly returned to the tank T through a path including the tank direct-communication line 33.

Specifically, the arm control valve 23 has a neutral position 23*a*, an arm-push position 23*b*, and an arm-retraction position 23*c*: when placed in the arm-push position 23*b*, the arm control valve 23 forms a supply flow path that leads the hydraulic oil supplied from the second hydraulic pump to the rod-side pipeline 34 to make the hydraulic oil reach the rod-side chamber 8*b* of the arm cylinder 8; when placed in the arm-retraction position 23*b*, the arm control valve 23 forms a supply flow path that leads the hydraulic oil to the head-side pipeline 35 to make the hydraulic oil reach the head-side chamber 8*a* of the arm cylinder 8.

For the return oil from the arm cylinder, the arm control valve 23 has first and second tank ports 36 and 37 as tank ports allowing the return oil to be flowed to the tank T, the individual return pipelines 28 being connected to the first tank port 36, and the tank direct-communication line 33 being connected to the second tank port 37. In addition, the arm control valve 23 includes: a flow path bringing the rod-side pipeline 34 into communication with the first tank port 36 in the arm-retraction position 23*c*, namely, a first return flow path 231 that leads the return oil returned from the rod-side chamber 8*b* through the rod-side pipeline 34 to the return pipeline including the individual return pipelines 28; and a flow path bringing the head-side pipeline 35 into communication with the second tank port 37 in the arm-push position 23*c*, namely, a second return flow path 232 that leads the return oil returned from the head-side chamber 8*a* through the head-side pipeline 35 to the tank direct-communication line 33.

The hydraulic circuit according to the present embodiment further includes: a regeneration pipeline 38 interconnecting the tank direct-communication line 33 and the rod-side pipeline 34 and a replenishment pipeline 39 interconnecting the tank direct-communication line 33 and the second tank line 29B. The regeneration pipeline 38 is provided with a regeneration check valve 40, which permits oil to be flowed, only in a direction from the tank direct-communication line 33 to the rod-side pipeline 34. The replenishment pipeline 39 is provided with a supply check valve 41, which permits oil to be flowed, only in a direction from the tank direct-communication line 33 to the second tank line 29B. Besides, a supply pipeline 42 with a check valve is provided between the second tank line 29B and the rod-side pipeline 34, and a supply pipeline 43 with a check valve is provided between the second tank line 29B and the head-side pipeline 35.

In this circuit, upon every operation in the arm-push (arm-cylinder-retract) direction, the hydraulic oil in the head-side chamber 8*a* of the arm cylinder 8 is directly returned to the tank T through the tank direct-communication line 33 not including the back-pressure valve 31 and the oil cooler 32; this enables the effect of reducing the pressure loss due to the return oil to be enhanced. Furthermore, this effect can be achieved by adding only one low pressure pipe, i.e., the tank direct-communication line 33; this allows the effect to be obtained at lower costs with a simple circuit requiring few parts compared with the related art disclosed in Patent Literature 1.

Besides, in the circuit according to the present embodiment, the regeneration pipeline 38 with the regeneration check valve 40, interconnecting the tank direct-communication line 33 and the rod-side pipeline 34, allows the return oil flowed from the head-side chamber 8*a* of the arm cylinder 8 to be supplied to the rod-side pipeline 34 to thus prevent cavitation from occurring, even when only the arm cylinder 8 is operated, that is, even in the operation which does not allow the return oil flowed from another actuator circuit to be regenerated for the rod-side chamber 8*b* side, such as a combined operation.

In addition, according to the present embodiment, the replenishment pipeline 39 with the supply check valve 41, interconnecting the tank direct-communication line 33 and the tank line 29, allows the return oil flowed from the head-side chamber 8*a* of the arm cylinder 8 to be supplied to a hydraulic actuator other than the arm cylinder, when a combined operation in which the arm cylinder 8 and the hydraulic actuator other than it are simultaneously operated is performed.

The present invention is not limited to the foregoing embodiment. For example, the circuit of the hydraulic circuit according to the present invention, that is, a circuit provided with a tank direct-communication line, is not limited to a circuit for the arm cylinder 8 according to the foregoing embodiment. Instead of the circuit for the arm cylinder 8 or together therewith, the present invention can be applied to a circuit for another cylinder (for example, a bucket cylinder or a boom cylinder).

In addition, the construction machine that is provided with the hydraulic circuit according to the present invention is not limited to a hydraulic shovel. Alternatively, the construction machine can be applied to another construction machine having a hydraulic shovel as a base member.

As described above, according to the present invention, provided is a hydraulic circuit for a construction machine including a hydraulic cylinder, the hydraulic circuit being capable of achieving a significant effect of reducing a pressure loss due to return oil that flowed from the head-side chamber of the hydraulic cylinder, with a simple structure. The provided hydraulic circuit includes: a hydraulic pump that discharges hydraulic oil; a hydraulic cylinder having a head-side chamber and a rod-side chamber and configured to be extended and retracted by hydraulic oil supplied from the hydraulic pump to the head-side chamber and the rod-side chamber; a control valve disposed between the hydraulic pump and the hydraulic cylinder and operated to control supply and discharge of the hydraulic oil to and from the hydraulic cylinder; a head-side pipeline connecting the head-side chamber of the hydraulic cylinder to the control valve; a rod-side pipeline connecting the rod-side chamber of the hydraulic cylinder to the control valve; a return pipeline connecting the control valve to a tank; a back-pressure valve provided to the return pipeline; an oil cooler provided to the return pipeline; and a tank direct-communication line other than the return pipeline, the tank direct-communication line providing direct communication between the control valve and the tank. The control valve has a first return flow path that leads return oil flowed from the head-side chamber of the hydraulic cylinder to the tank direct-communication line and a second return flow path that leads return oil flowed from the rod-side chamber of the hydraulic cylinder to the return pipeline.

This hydraulic circuit always allow the hydraulic oil in the head-side chamber of the hydraulic cylinder to be directly returned to the tank through the tank direct-communication line not including the back-pressure valve and the oil cooler, thereby enabling the effect of reducing the pressure loss due to the return oil flowed when the operation for retracting the hydraulic cylinder is performed. In addition, the effect can be achieved with a simple circuit configuration with use of few parts wherein only one low pressure pipe, namely, the tank direct-communication line, is added, thus reducing cost.

The hydraulic circuit according to the present invention preferably further includes a regeneration pipeline interconnecting the tank direct-communication line and the rod-side pipeline, the regeneration pipeline including a regeneration check valve that permits oil to be flowed only in a direction from the tank direct-communication line to the rod-side pipeline. This regeneration circuit allows the return oil flowed from the head-side chamber of the arm cylinder to be supplied to the rod-side pipeline even when only the arm cylinder is operated, that is, even when the return oil flowed from another actuator circuit cannot be regenerated for the rod-side chamber side, for example, even when a combined operation is performed, thereby preventing cavitation from occurring.

Besides, the hydraulic circuit according to the present invention preferably further includes: a second hydraulic actuator other than the hydraulic cylinder; a second control valve provided for the second hydraulic actuator; and a supply pipeline, the return pipeline including a plurality of individual return pipelines provided for the control valve for the hydraulic cylinder and the second control valves, respectively, and a tank line shared by the individual return pipelines to connect the individual return pipelines to the tank, the supply pipeline connecting the tank direct-communication line to the tank line and including a supply check valve that permits oil to be flowed only in a direction from the tank direct-communication line to the tank line. The supply pipeline enables the return oil flowed from the head-side chamber of the arm cylinder to be supplied to the second hydraulic actuator when a combined operation, in which the arm cylinder and another hydraulic actuator are simultaneously operated, is performed.

The invention claimed is:

1. A hydraulic circuit for a construction machine, comprising:

a hydraulic pump that discharges hydraulic oil;

a hydraulic cylinder having a head-side chamber and a rod-side chamber and configured to be extended and retracted by hydraulic oil supplied from the hydraulic pump to the head-side chamber and the rod-side chamber;

a control valve disposed between the hydraulic pump and the hydraulic cylinder and operated to control supply and discharge of the hydraulic oil to and from the hydraulic cylinder;

a head-side pipeline connecting the head-side chamber of the hydraulic cylinder to the control valve;

a rod-side pipeline connecting the rod-side chamber of the hydraulic cylinder to the control valve;

a return pipeline connecting the control valve to a tank;

a back-pressure valve provided to the return pipeline;

an oil cooler provided to the return pipeline; and a tank direct-communication line other than the return pipeline, the tank direct-communication line providing direct communication between the control valve and the tank, wherein the control valve has a first return flow path that leads return oil flowed from the head-side chamber of the hydraulic cylinder to the tank direct-communication line and a second return flow path that leads return oil flowed from the rod-side chamber of the hydraulic cylinder to the return pipeline, further comprising a regeneration pipeline connecting the tank direct-communication line to the rod-side pipeline, the regeneration pipeline including a regeneration check valve that permits oil to be flowed only in a direction from the tank direct-communication line to the rod-side pipeline.

2. A hydraulic circuit for a construction machine, comprising:

a hydraulic pump that discharges hydraulic oil;

a hydraulic cylinder having a head-side chamber and a rod-side chamber and configured to be extended and retracted by hydraulic oil supplied from the hydraulic pump to the head-side chamber and the rod-side chamber;

a control valve disposed between the hydraulic pump and the hydraulic cylinder and operated to control supply and discharge of the hydraulic oil to and from the hydraulic cylinder;

a head-side pipeline connecting the head-side chamber of the hydraulic cylinder to the control valve;

a rod-side pipeline connecting the rod-side chamber of the hydraulic cylinder to the control valve;

a return pipeline connecting the control valve to a tank;

a back-pressure valve provided to the return pipeline;

an oil cooler provided to the return pipeline; and a tank direct-communication line other than the return pipeline, the tank direct-communication line providing direct communication between the control valve and the tank, wherein the control valve has a first return flow path that leads return oil flowed from the head-side chamber of the hydraulic cylinder to the tank direct-communication line and a second return flow path that leads return oil flowed from the rod-side chamber of the hydraulic cylinder to the return pipeline, further comprising: a second hydraulic actuator other than the hydraulic cylinder; a second control valve provided for the second hydraulic actuator; and a supply pipeline, the return pipeline including a plurality of individual return pipelines provided for the control valve for the hydraulic cylinder and the second control valve, respectively, and a tank line shared by the individual return pipelines to connect the individual return pipelines to the tank, the supply pipeline connecting the tank direct-communication line to the tank line and including a supply check valve that permits oil to be flowed only in a direction from the tank direct-communication line to the tank line.

* * * * *